US008259054B2

(12) United States Patent
Lee

(10) Patent No.: US 8,259,054 B2
(45) Date of Patent: Sep. 4, 2012

(54) LIQUID CRYSTAL DISPLAY DEVICE AND METHOD OF CONTROLLING THE SAME FOR REMOVING EXCITATION VOLTAGE

(75) Inventor: Deuk Woo Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 791 days.

(21) Appl. No.: 11/980,385

(22) Filed: Oct. 31, 2007

(65) Prior Publication Data

US 2008/0100550 A1 May 1, 2008

(30) Foreign Application Priority Data

Nov. 1, 2006 (KR) ..... 10-2006-0107061

(51) Int. Cl.
*G09G 3/36* (2006.01)

(52) U.S. Cl. ..... 345/99

(58) Field of Classification Search ..... 345/99, 345/100

See application file for complete search history.

(56) References Cited

U.S. PATENT DOCUMENTS

| | | | | |
|---|---|---|---|---|
| 6,236,393 | B1 * | 5/2001 | Ogawa et al. | 345/211 |
| 6,429,838 | B1 * | 8/2002 | Go | 345/87 |
| 7,050,027 | B1 * | 5/2006 | Macrae | 345/87 |
| 2005/0001790 | A1 * | 1/2005 | Park | 345/10 |

FOREIGN PATENT DOCUMENTS

JP 2004208303 A * 7/2004

* cited by examiner

*Primary Examiner* — Chanh Nguyen
*Assistant Examiner* — John Kirkpatrick
(74) *Attorney, Agent, or Firm* — McKenna Long & Aldridge LLP

(57) ABSTRACT

A liquid crystal display device includes a liquid crystal panel, a driver that drives the liquid crystal panel, an input unit that inputs an option signal from outside the liquid crystal device, a controller that controls the driver and performs an option function corresponding to the option signal, and a buffer disposed between the input unit and the controller that removes an excitation voltage from the option signal output from the input unit.

2 Claims, 3 Drawing Sheets

LIQUID CRYSTAL DISPLAY DEVICE AND METHOD OF CONTROLLING THE SAME FOR REMOVING EXCITATION VOLTAGE

The present application claims priority under 35 U.S.C. 119 and 35 U.S.C. 365 to Korean Patent Application No. 10-2006-0107061 filed on Nov. 1, 2006, which is hereby incorporated by reference in its entirety.

BACKGROUND OF THE INVENTION

1. Field of the Invention

The present invention relates to a liquid crystal display device. More particularly, the present invention relates to a liquid crystal display device and method of controlling the same, capable of preventing excitation voltage with respect to an option signal.

2. Description of the Related Art

Liquid crystal display devices (LCDs) are more widely used due to the characteristics of light weight, thin thickness, low-power-consumption driving, and so on. As a result, the LCDs are applied to office automation equipment, audio/video equipment, and so on. Meanwhile, the LCDs adjust an amount of transmitted light on the basis of image signals applied to a plurality of control switches arranged in a matrix pattern, thereby displaying a desired image on a screen.

The LCDs can change a data format, the driving mode of a timing controller, etc. through an option signal supplied from a system so as to be able to carry out a function selected by a user from the outside.

FIG. 1 is a view illustrating a related art LCD.

As illustrated in FIG. 1, the related art LCD includes a liquid crystal panel 2 having a plurality of gate lines GL1 through GLn and a plurality of data lines DL1 through DLm arranged, a gate driver 4 driving the plurality of gate lines GL1 through GLn, a data driver 6 driving the plurality of data lines DL1 through DLm, a timing controller 8 controlling the gate driver 4 and the data driver 6, and a user connector 10 supplying an option signal to the timing controller 8.

In the liquid crystal panel 2, the gate lines GL1 through GLn are arranged perpendicular to the data lines DL1 through DLm, and each intersection between the gate lines and the data lines has a thin film transistor (TFT) that is a switching element, and a pixel electrode that is electrically connected with the TFT.

The liquid crystal panel 2 includes a first substrate formed with the TFT and the pixel electrode, a second substrate formed with red, green, and blue color filters, and a liquid crystal layer formed between the first and second substrates.

The gate driver 4 sequentially supplies gate scan signals (gate high voltage and gate low voltage) to the gate lines GL1 through GLn on the basis of a gate control signal supplied from the timing controller 8.

The data driver 6 supplies data voltage to the data lines DL1 through DLm on the basis of a data control signal supplied from the timing controller 8.

The timing controller 8 generates the gate control signal controlling the gate driver 4 and the data control signal controlling the data driver 6 using vertical/horizontal synchronizing signals and a clock signal supplied from a system that is not shown.

When the option signal is supplied to the system so as to be able to perform a function that a user changes a data format or a driving mode of the timing controller from the outside, the system supplies the option signal to the user connector 10.

The user connector 10 supplies the option signal to an option pin of the timing controller 8 through a line. When the option signal is supplied to the option pin of the timing controller 8, the timing controller 8 performs the function corresponding to the option signal.

Specifically, the option signal is supplied to a node A to which first and second diodes D1 and D2 of the timing controller 8 are connected.

Meanwhile, the user connector 10 is connected with the option pin, i.e. the node A, of the timing controller 8 through the line. An excitation voltage such as static electricity (called ESD, electrostatic discharge) may be input into the line from the outside. When input into the line between the user connector 10 and the node A of the timing controller 8, this excitation voltage is supplied to the node A of the timing controller 8, so that the timing controller 8 causes malfunction.

More specifically, when supplied to the node A of the timing controller 8, the excitation voltage has an influence on a reset terminal of the timing controller 8, so that the timing controller 8 causes malfunction.

When the reset terminal is supplied with input voltage Vcc from the outside, the timing controller 8 is reset to prepare for driving. When the reset terminal carrying out this function is supplied with the excitation voltage having a level higher than that of the input voltage Vcc, the reset terminal may perform reset operation in spite of the circumstance that the reset terminal should not perform the reset operation. For this reason, the timing controller 8 causes malfunction.

As described above, when the excitation voltage is input into the reset terminal of the timing controller 8, the timing controller 8 has a problem in that it causes malfunction.

SUMMARY OF THE INVENTION

Accordingly, the present invention is directed to a liquid crystal display device that substantially obviates one or more of the problems due to limitations and disadvantages of the related art.

An advantage of the present invention is to provide a liquid crystal display device and method of controlling the same, capable of preventing excitation voltage from being input into an option signal.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the present invention, as embodied and broadly described, a liquid crystal display device includes a liquid crystal panel, a driver that drives the liquid crystal panel, an input unit that inputs an option signal from the outside, a controller that controls the driver and performs an option function corresponding to the option signal, and a buffer disposed between the input unit and the controller that removes an excitation voltage from the option signal output from the input unit.

In another aspect of the present invention, a method of controlling a liquid crystal display device includes inputting an option signal, removing a component of excitation voltage from the option signal, and controlling a driver of a liquid crystal panel so as to perform an option function corresponding to the option signal.

It is to be understood that both the foregoing general description and the following detailed description of the present invention are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention together with the description, and serve to explain the principle of the invention.

DETAILED DESCRIPTION OF THE ILLUSTRATED EMBODIMENTS

Hereinafter, an embodiment of the present invention will be described with reference to the accompanying drawings.

Figure 1:
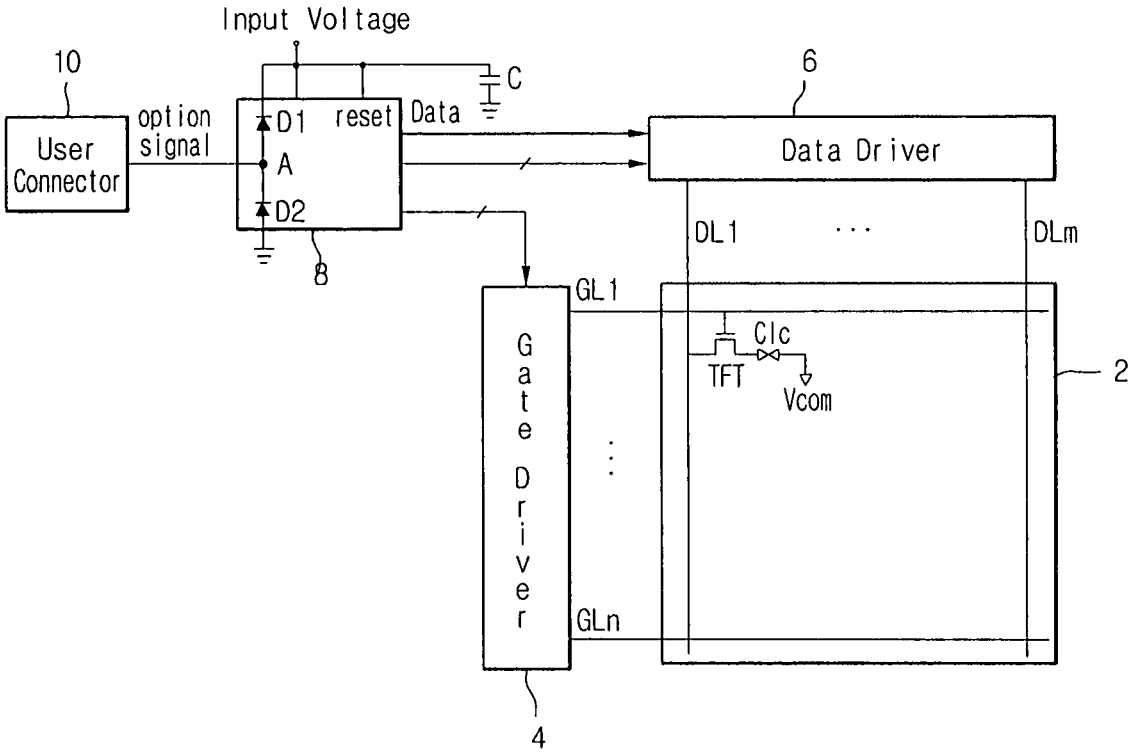
FIG. 1 (Related Art)
FIG. 1 is a view illustrating a related art LCD.
Figure 2:
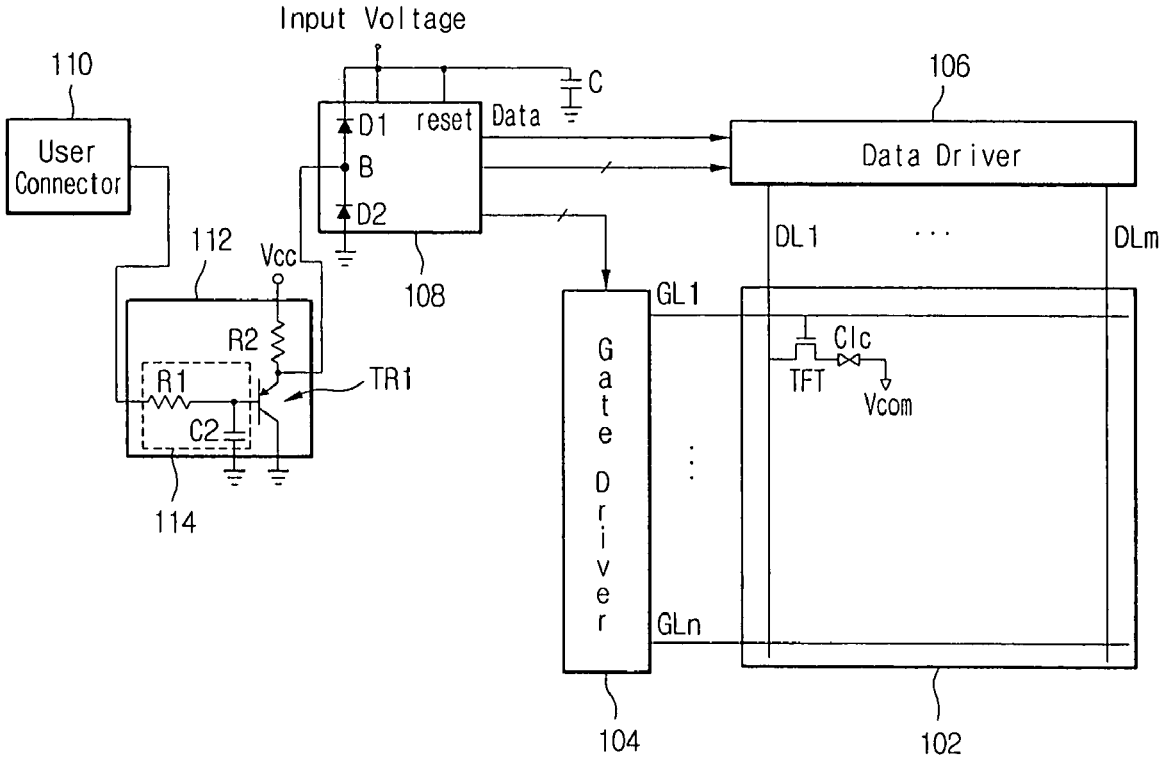
FIG. 2 is a view illustrating a liquid crystal display device (LCD) according to the prevent invention.

FIG. 2 is a view illustrating a liquid crystal display device (LCD) according to the present invention.

As illustrated in FIG. 2, the LCD according to the present invention includes a liquid crystal panel 102 having a plurality of gate lines GL1 through GLn and a plurality of data lines DL1 through DLm arranged to display a desired image, a gate driver 104 driving the plurality of gate lines GL1 through GLn, a data driver 106 driving the plurality of data lines DL1 through DLm, a timing controller 108 controlling the gate driver 104 and the data driver 106, a buffer 112 supplying an option signal to the timing controller 108 through switching, and a user connector 110 supplying the option signal to the buffer 112.

The liquid crystal panel 102 includes a first substrate having the plurality of gate lines GL1 through GLn crossing the plurality of data lines DL1 through DLm, a second substrate formed with red, green, and blue color filters, and a liquid crystal layer that is formed between the first and second substrates and is driven by a potential difference between the first and second substrates.

At the first substrate of the liquid crystal panel 2, the gate lines GL1 through GLn are arranged perpendicular to the data lines DL1 through DLm, and each intersection between the gate lines and the data lines is formed with a thin film transistor (TFT) that is a switching element, and a pixel electrode that is electrically connected with the TFT.

The TFTs are connected with the gate lines GL1 through GLn, and thus are controlled by gate scan signals supplied to the gate lines GL1 through GLn. When one of the gate scan signals, i.e. gate high voltage VGH, is supplied to the gate lines GL1 through GLn, the TFTs are turned on. In contrast, when the other of the gate scan signals, i.e. gate low voltage VGL, is supplied to the gate lines GL1 through GLn, the TFTs are turned off.

The gate driver 104 sequentially supplies the gate scan signals, i.e. the gate high voltage VGH and the gate low voltage VGL, to the gate lines GL1 through GLn on the basis of a gate control signal supplied from the timing controller 108.

The data driver 106 supplies data voltage, which corresponds to the image to be displayed on the liquid crystal panel 102, to the data lines DL1 through DLm on the basis of a data control signal supplied from the timing controller 108.

The timing controller 108 generates the gate control signal controlling the gate driver 104 and the data control signal controlling the data driver 106 using vertical/horizontal synchronizing signals and a clock signal supplied from a system that is not shown.

Further, the timing controller 108 properly aligns data supplied from the system to be in harmony with a mode of the liquid crystal panel 102, and then supplies the aligned data to the data driver 106.

When intending to perform a function that a user changes a data format, a driving mode of the timing controller, etc. from the outside, the user connector 110 receives the option signal corresponding to the function from the system, and then supplies the option signal to the buffer 112. At this time, the user connector 110 is electrically connected with the buffer 112 through a line.

The buffer 112 supplies the option signal, which is received from the user connector 110, to an option pin of the timing controller 108. When the option signal is supplied to the option pin of the timing controller 108, the timing controller 108 performs the function corresponding to the option signal.

Specifically, the option signal supplied from the buffer 112 is supplied to a node B (hereinafter, referred to as "option pin") to which first and second diodes D1 and D2 of the timing controller 108 are connected. The timing controller 108 includes a reset terminal. When the reset terminal is supplied with input voltage Vcc from the outside, the timing controller 108 is reset to prepare for driving.

The buffer 112 may be supplied with an excitation voltage such as static electricity (called ESD, electrostatic discharge) from the outside through the line between the user connector 110 and the buffer 112. The buffer 112 serves to prevent the excitation voltage from being input into the option pin of the timing controller 108.

Here, the buffer 112 is connected with the option pin of the timing controller 108 through the line. When the buffer 112 supplies the option signal, which is supplied from the user connector 110, to the option pin of the timing controller 108 through the line, the excitation voltage may be input. In order to prevent this phenomenon, the buffer 112 may be disposed in the timing controller 108.

The buffer 112 may include a first transistor TR1 and a filter 114. As the first transistor TR1, a PNP type transistor is used. The first transistor TR1 is turned on when the option signal of a low level is supplied from the user connector 110, whereas the first transistor TR1 is turned off when the option signal of a high level is supplied from the user connector 110.

The first transistor TR1 of the PNP type has a base terminal connected electrically with the filter 114, a collector (or emitter) terminal supplied with the input voltage Vcc from the outside through a second resistor element R2, and an emitter (or collector) terminal supplied with ground voltage GND. At this time, the collector terminal is electrically connected with the option pin of the timing controller 108. In this case, the second resistor element R2 is used as a pull-up resistor.

The filter 114 may include a low-pass filter made up of a first resistor element R1 and a second capacitor element C2. The filter 114 functions to remove a high-frequency component of the option signal supplied from the user connector 110.

When the excitation voltage of a high-frequency component is supplied to the option signal, the filter 114 removes the excitation voltage, and thus supplies the option signal, from which the excitation voltage is removed, to the first transistor TR1.

Because the filter 114 primarily removes the excitation voltage of the high-frequency component, the excitation voltage may be supplied to the first transistor TR1 without perfect removal.

The first transistor TR1 is the PNP type as described above, so that it is turned on only when the low-level option signal is input.

Thus, although the excitation voltage of the high-frequency component is supplied to the first transistor TR1 without being removed by the filter 114, the first transistor TR1 is not turned on. For this reason, the excitation voltage cannot be supplied to the timing controller 108.

Consequently, the first transistor TR1 is turned on only when the option signal having a level lower than that of the excitation voltage is supplied from the user connector 110, so that the option signal is supplied to the option pin of the timing controller 108.

In this manner, the buffer 112 can prevent the excitation voltage from being input into the timing controller 108 from the outside using characteristics of the first transistor TR1 of the PNP type.

Figure 3:
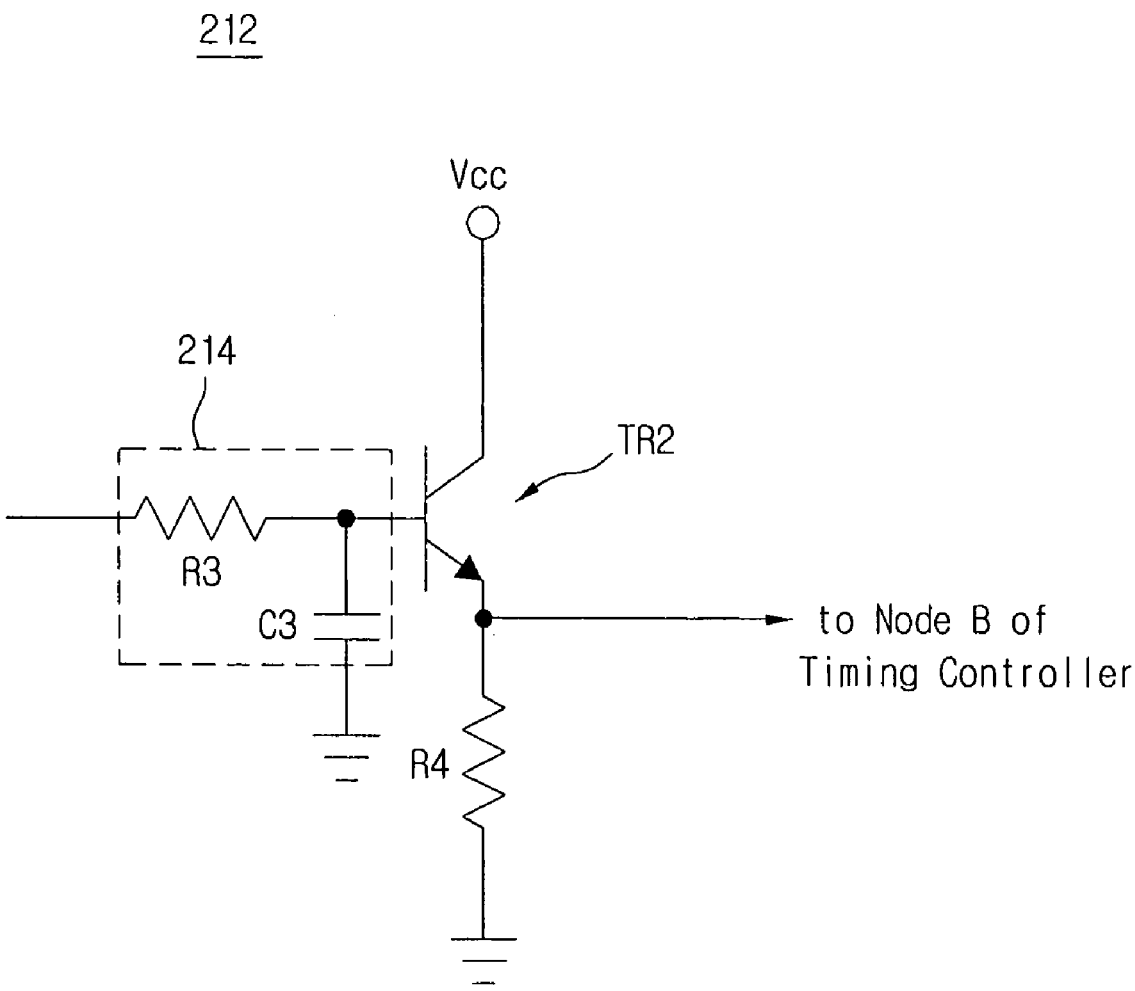
FIG. 3 illustrates another embodiment of the buffer of FIG. 2.

FIG. 3 illustrates another embodiment of the buffer of FIG. 2.

As illustrated in FIG. 3, the buffer 112 according to another embodiment includes a second transistor TR2 of an N type and a filter 214. For the second transistor TR2, an NPN type transistor is used. The second transistor TR2 is turned off when the option signal of a low level is supplied from the user connector 110 (FIG. 2), whereas the second transistor TR2 is turned on when the option signal of a high level is supplied from the user connector 110.

The second transistor TR2 of the NPN type has a base terminal connected electrically with the filter 214, a collector terminal supplied with the input voltage Vcc from the outside, and an emitter terminal connected electrically with the node B of the timing controller 108 illustrated in FIG. 2. The emitter terminal of the second transistor TR2 is connected to the ground voltage GND. via a fourth resistor element R4. The fourth resistor element R4 is used as a load resistor (or a pull-down resistor) of the second transistor TR2.

The filter 214 can include a low-pass filter made up of a third resistor element R3 and a third capacitor element C3. The filter 214 functions to remove a high-frequency component of the option signal supplied from the user connector 110 (FIG. 2).

When the excitation voltage with a high-frequency component is supplied to the option signal, the filter 214 removes the excitation voltage, and thus supplies the option signal, from which the excitation voltage is removed, to the second transistor TR2.

Because the filter 214 primarily removes the excitation voltage of the high-frequency component, the excitation voltage may be supplied to the second transistor TR2 without perfect removal.

The second transistor TR2 is turned on when the high-level option signal is supplied to the base terminal of the second transistor TR2 through the filter 214. When the second transistor TR2 is turned on, the collector and emitter terminals of the second transistor TR2 are electrically connected with each other, and the input voltage Vcc supplied to the collector terminal of the second transistor TR2 is supplied to the emitter terminal of the second transistor TR2. Because the emitter terminal of the second transistor TR2 is electrically connected with the node B of the timing controller 108, the input voltage Vcc is supplied to the node B of the timing controller 108.

Further, the second transistor TR2 is turned off when the low-level option signal is supplied to the base terminal of the second transistor TR2 through the filter 214, so that the ground voltage GND is supplied to the node B of the timing controller 108.

Consequently, when the option signal including the excitation voltage is supplied to the second transistor TR2, the input voltage Vcc is supplied to the node B of the timing controller 108. For this reason, malfunction of the timing controller 108 may be prevented because the excitation voltage exerts no influence on the reset terminal of the timing controller 108.

The excitation voltage generated from outside is prevented from being input into the option pin of the timing controller 108, and thus exerts no influence on the reset terminal of the timing controller 108. Thereby, the problems of the related LCD may be improved.

As described above, the LCD according to the present invention has the buffer between the user connector, which supplies the option signal corresponding to the function selected by the user from the outside, and the timing controller, which performs the function corresponding to the option signal, so that the excitation voltage, such as the ESD, generated from outside may be prevented from being input into the timing controller.

Further, the LCD according to the present invention prevents the excitation voltage from being input into the timing controller, and thus exerts no influence on the reset terminal of the timing controller, so that the problems of the related LCD may be improved.

It will be apparent to those skilled in the art that various modifications and variation can be made in the present invention without departing from the spirit or scope of the invention. Thus, it is intended that present invention cover the modification and variations of this invention provided they come within the scope of the appended claims and their equivalents.

What is claimed is:

1. A liquid crystal display device comprising:

a liquid crystal panel;

a driver that drives the liquid crystal panel;

an input unit that inputs an option signal from outside the liquid crystal display;

a controller that controls the driver and performs an option function corresponding to the option signal; and a buffer disposed only between the input unit and the controller that removes an excitation voltage from the option signal output from the input unit, the excitation voltage having a voltage level greater than an input voltage, wherein the buffer includes a control switch that enables a supply voltage on a supply voltage line and a ground voltage on a ground voltage line to be selectively output to the controller in response to the option signal from the input unit and a filter connected between the input unit and the control switch for removing noise included in the option signal, wherein the filter is a low-pass filter removing the noise of a high-frequency component, wherein the control switch is a transistor having an emitter terminal, a base terminal and a collector terminal, wherein the base terminal of the control switch is connected to the low-pass filter, wherein the option signal performs a function that a user changes a data format or a driving mode and not a common voltage of the controller, wherein the option signal is supplied to the buffer by the input unit, wherein the control switch includes a PNP type transistor, wherein the control switch is turned on only when the option signal is at a voltage level less than that of the excitation voltage, and wherein the emitter terminal of the control switch is connected only to an option pin of the controller where a first and a second diode of the controller are connected.

2. The liquid crystal display device as claimed in claim 1, wherein the buffer further includes a pull-up resistor connected between the PNP type transistor and the supply voltage line.

* * * * *